US011946349B2

(12) United States Patent
Xie et al.

(10) Patent No.: US 11,946,349 B2
(45) Date of Patent: Apr. 2, 2024

(54) DOWNHOLE THROTTLING DEVICE BASED ON WIRELESS CONTROL

(71) Applicants: PetroChina Company Limited, Beijing (CN); Sichuan Shengnuo Oil. And Gas Engineering Technology Service Co., Ltd, Sichuan (CN)

(72) Inventors: Jun Xie, Beijing (CN); Huiyun Ma, Beijing (CN); Jian Yang, Beijing (CN); Chenggang Yu, Beijing (CN); Yukun Fu, Beijing (CN); Qiang Yin, Beijing (CN); Kui Li, Beijing (CN); Yuan Jiang, Beijing (CN); Dezheng Yi, Beijing (CN); Yanyan Liu, Beijing (CN); Haifeng Zhong, Beijing (CN); Xiaodong Liu, Beijing (CN)

(73) Assignees: PetroChina Company Limited, Beijing (CN); Sichuan Shengnuo Oil. And Gas Engineering Technology Service Co., Ltd, Deyang (CN)

( * ) Notice: Subject to any disclaimer, the term of this patent is extended or adjusted under 35 U.S.C. 154(b) by 315 days.

(21) Appl. No.: 17/606,836

(22) PCT Filed: Sep. 15, 2020

(86) PCT No.: PCT/CN2020/115228
§ 371 (c)(1),
(2) Date: Oct. 27, 2021

(87) PCT Pub. No.: WO2021/052301
PCT Pub. Date: Mar. 25, 2021

(65) Prior Publication Data

US 2022/0205346 A1 Jun. 30, 2022

(30) Foreign Application Priority Data

Sep. 19, 2019 (CN) ..... 201910889181.0

(51) Int. Cl.
*E21B 43/12* (2006.01)
*E21B 34/06* (2006.01)
*E21B 34/14* (2006.01)

(52) U.S. Cl.
CPC ..... *E21B 43/123* (2013.01); *E21B 34/066* (2013.01); *E21B 34/14* (2013.01); *E21B 43/12* (2013.01); *E21B 2200/02* (2020.05)

(58) Field of Classification Search
CPC ..... E21B 43/123; E21B 43/12; E21B 34/066; E21B 34/14; E21B 2200/02
(Continued)

(56) References Cited

U.S. PATENT DOCUMENTS 4,083,401 A 4/1978 Rankin
6,148,843 A * 11/2000 Pringle ..... E21B 34/066 137/155
(Continued)

FOREIGN PATENT DOCUMENTS

CN 201428440 Y 3/2010
CN 202170785 U 3/2012
(Continued)

OTHER PUBLICATIONS

International search report issued for counterpart Chinese patent application No. PCT/CN2020/115228 dated Dec. 15, 2020.
(Continued)

*Primary Examiner* — Minh Q Le
(74) *Attorney, Agent, or Firm* — Michael Best & Friedrich LLP

(57) ABSTRACT

A downhole throttling device based on wireless control includes an inlet nozzle, a throttling assembly, an electrical sealing cylinder, a gas guide cylinder, a lower adapter sleeve, an end socket, a female sleeve, and electrical components. The inlet nozzle is connected to the throttling
(Continued)

assembly, the throttling assembly is connected to the electrical sealing cylinder and the gas guide cylinder, the electrical sealing cylinder and the gas guide cylinder are both connected to the lower adapter sleeve, the lower adapter sleeve is respectively connected to the end socket and the female sleeve, and the electrical components are arranged in the electrical sealing cylinder. A throttling effect is achieved by detecting the temperature and pressure in a tube by a temperature/pressure sensor in the electrical components and controlling a motor to rotate a movable valve in the throttling assembly by a circuit control assembly, thereby achieving wireless control over downhole throttling.

6 Claims, 3 Drawing Sheets

(58) Field of Classification Search
USPC ..... 137/155; 166/338, 339, 344, 363, 166/250.15, 248, 155
See application file for complete search history.

(56) References Cited

U.S. PATENT DOCUMENTS

| | | | | |
|---|---|---|---|---|
| 7,073,594 | B2 * | 7/2006 | Stegemeier | E21B 43/16 166/73 |
| 7,896,067 | B2 * | 3/2011 | Rayssiguier | E21B 17/1085 166/242.7 |
| 11,655,689 | B2 * | 5/2023 | Merron | E21B 34/066 166/250.01 |
| 11,702,913 | B2 * | 7/2023 | Shaw | E21B 34/066 166/373 |
| 2010/0243243 | A1 * | 9/2010 | Chen | E21B 34/16 166/250.15 |
| 2010/0307773 | A1 * | 12/2010 | Tinnen | E21B 33/12 166/120 |
| 2013/0048290 | A1 * | 2/2013 | Howell | E21B 34/08 166/305.1 |
| 2015/0009039 | A1 * | 1/2015 | Tinnen | H04B 11/00 340/850 |
| 2015/0034323 | A1 * | 2/2015 | Greene | E21B 43/12 166/305.1 |
| 2015/0226030 | A1 * | 8/2015 | Mackenzie | E21B 34/066 166/373 |
| 2016/0290099 | A1 * | 10/2016 | Balasubramanian | F16K 31/025 |
| 2018/0274331 | A1 * | 9/2018 | Richards | E21B 43/045 |
| 2023/0132593 | A1 * | 5/2023 | Fripp | E21B 33/12 166/281 |

FOREIGN PATENT DOCUMENTS

| | | | |
|---|---|---|---|
| CN | 202187750 | U | 4/2012 |
| CN | 106988709 | U | 7/2017 |
| CN | 206338053 | U | 7/2017 |
| CN | 207795189 | U | 8/2018 |
| CN | 209053599 | U | 7/2019 |
| CN | 110500066 | A | 11/2019 |
| EA | 8718 | B1 | 6/2007 |
| RU | 2273727 | C2 | 4/2006 |
| RU | 2385409 | C2 | 3/2010 |
| RU | 2475643 | C2 | 2/2013 |
| RU | 2530810 | C2 | 10/2014 |
| RU | 150456 | U1 | 2/2015 |
| WO | 0106130 | A | 1/2001 |

OTHER PUBLICATIONS

First Office Action and search report dated Jan. 14, 2020 for counterpart Chinese patent application No. 201910889181.0 with machine EN translation downloaded from EPO.
Second Action and search report dated Mar. 2, 2020 for counterpart Chinese patent application No. 201910889181.0 with machine EN translation downloaded from EPO.
Third Office Action and search report dated Apr. 16, 2020 for counterpart Chinese patent application No. 201910889181.0 with machine EN translation downloaded from EPO.
Russian Patent Office Action for Application No. 2021127264/03 dated Mar. 5, 2022 (17 pages including English translation).

* cited by examiner

DOWNHOLE THROTTLING DEVICE BASED ON WIRELESS CONTROL

This application is the U.S. National stage entry, under 35 U.S.C. § 371 of International Application No. PCT/CN2020/115228, filed Sep. 15, 2020, which claims priority to Chinese Patent Application No. 201910889181.0, filed on Sep. 19, 2019, the entire contents of which being incorporated herein by reference.

TECHNICAL FIELD

This disclosure relates to the technical field of oil and natural gas production equipment, and in particular, to a downhole throttling device based on wireless control.

BACKGROUND

Downhole throttle technology started early. As early as the 1940*s*, foreign experts put forward an idea of using bottom hole nozzles in flowing wells to eliminate or reduce the excitement intermittence of oil wells. However, the replacement of the bottom nozzles and changing size of the nozzles require removing the oil tubes, which is troublesome, so this method has not been popularized and applied in time. The existing intelligent completion tool systems in foreign countries mainly use flow control devices such as automatic casing switch spool valves. There is no throttling tool specifically for the downhole string of the gas flow production channel. Presently, there is no mature wireless intelligent tools for controlling downhole fluid flow in China. Commonly used throttling devices are mainly divided into movable downhole throttling devices and fixed downhole throttling devices, which both are mechanical throttling devices.

Downhole throttle technology has been widely applied in the Southwest Oil and Gas Field, saving an average investment of more than 1.5 million Yuan for a single well, shortening an average construction and commissioning period of a single well by 15 to 20 days, and realizing the development of scale and benefits of gas reservoirs. During 2002~2018, the number of salvage and replacement of downhole throttling devices exceeded 200 wells. Among them, it is mainly due to the need of production regulation to carry out rope operation for salvaging downhole throttling devices and replace nozzles with different nozzle diameters. The operation time for a single replacement of the throttling device is about 4 to 5 days, which requires material and manpower such as the well test trucks, long operation cycle and high costs and risk.

SUMMARY

An objective of this disclosure is to overcome the disadvantages of the prior art by providing a throttling device that can remotely control the downhole throttling of natural gas.

The objective of this disclosure is implemented through the technical proposal as follows: a downhole throttling device based on wireless control comprising an inlet nozzle, a throttling assembly, an electrical sealing cylinder, a gas guide cylinder, a lower adapter sleeve, an end socket, a female sleeve, and electrical components, wherein the inlet nozzle is connected to the throttling assembly, the throttling assembly is connected to the electrical sealing cylinder and the gas guide cylinder, the electrical sealing cylinder is arranged in the gas guide cylinder, the electrical sealing cylinder and the gas guide cylinder are both connected to the lower adapter sleeve, the lower adapter sleeve is respectively connected to the end socket and the female sleeve, the end socket is in the female sleeve, and the electrical components are arranged in the electrical sealing cylinder.

The throttling assembly comprises an upper adapter sleeve, a middle adapter sleeve, a static valve, and a moving valve, wherein the upper adapter sleeve is respectively connected to the inlet nozzle and the middle adapter sleeve, the middle adapter sleeve is connected to the electrical sealing cylinder and the gas guide cylinder, the static valve is arranged in the upper adapter sleeve, the moving valve is arranged in the upper adapter sleeve and the middle adapter sleeve, and the moving valve is connected to the middle adapter sleeve via a bearing.

The static valve is provided with a plurality of ventilation ducts communicating with the inlet nozzle, the movable valve is provided with a plurality of ventilation ducts at positions corresponding to that of the static valve, and the middle adapter sleeve is provided with a plurality of ventilation ducts communicating with the gas guide cylinder at positions corresponding to that of the moving valve. After the moving valve is deflected, the cross-sectional area of the ventilation ducts communicating the static valve and the moving valve is changed.

The electrical components comprise a motor, a circuit control assembly, a battery assembly, and a sensor, wherein the output shaft of the motor is connected to the moving valve. The motor, the battery assembly and the sensor are electrically connected to the circuit control assembly. The motor, the circuit control assembly and the battery assembly are arranged in the electrical sealing cylinder, the sensor is arranged in the end socket, and the sensing probe of the sensor passes through the end socket and is in the female sleeve.

The sensor is a temperature and pressure integrated sensor.

A locating pin for preventing rotation is provided between the upper adapter sleeve and the static valve.

The lower adapter sleeve is provided with a plurality of ventilation ducts.

This disclosure has the following advantages:

1. It is possible to control and adjust the opening degree of the downhole throttling nozzle remotely and wirelessly on the ground by simply using the existing well site gas production wellhead device, which changes the traditional way of shutting in the well and replacing the throttling nozzle by means of the rope operation, saving a lot of manpower, material resources and time costs.
2. The downhole wireless intelligent production adjustment technology is realized through the cooperation of sensors and motors, which satisfies the digitization and automation requirements in digital natural gas field technology well. It can guide the technicians to adjust the production of natural gas wells effectively and quickly in accordance with production needs, enhance the safety of development of natural gas wells, improve work quality and operating efficiency, and reduce operating costs.

BRIEF DESCRIPTION OF DRAWINGS

To explain the technical solutions of the embodiments in this disclosure more clearly, a brief introduction will be made to the drawings for the embodiments. It is to be understood that the drawings described below involve only some embodiments described in this disclosure, and those skilled in the art may arrive at drawings for other embodiments from this disclosure without creative efforts. In the drawings.

The reference signs are as follows: 1—inlet nozzle, 2—throttling assembly, 3—electrical sealing cylinder, 4—gas guide cylinder, 5—lower adapter sleeve, 6—end socket, 7—female sleeve, 8—electrical components, 9—locating pin, 201—upper adapter sleeve, 202—middle adapter sleeve, 203—static valve, 204—moving valve, 801—motor, 802—circuit control assembly, 803—battery assembly, 804—sensor.

DESCRIPTION OF EMBODIMENTS

In order to make the objectives, technical solutions and advantages of the embodiments of this disclosure clearer, the embodiments of this disclosure will be further described in detail in combination with accompanying drawings. Here, the exemplary embodiments of this disclosure and the description thereof are used to explain this disclosure but do not limit this disclosure.

Figure 1:
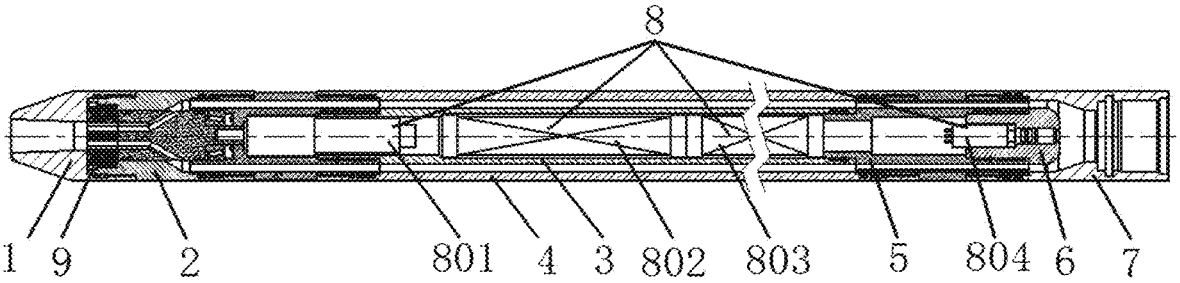
FIG. 1 is a cross-sectional view of a downhole throttling device based on wireless control in an embodiment of this disclosure.
Figure 3:
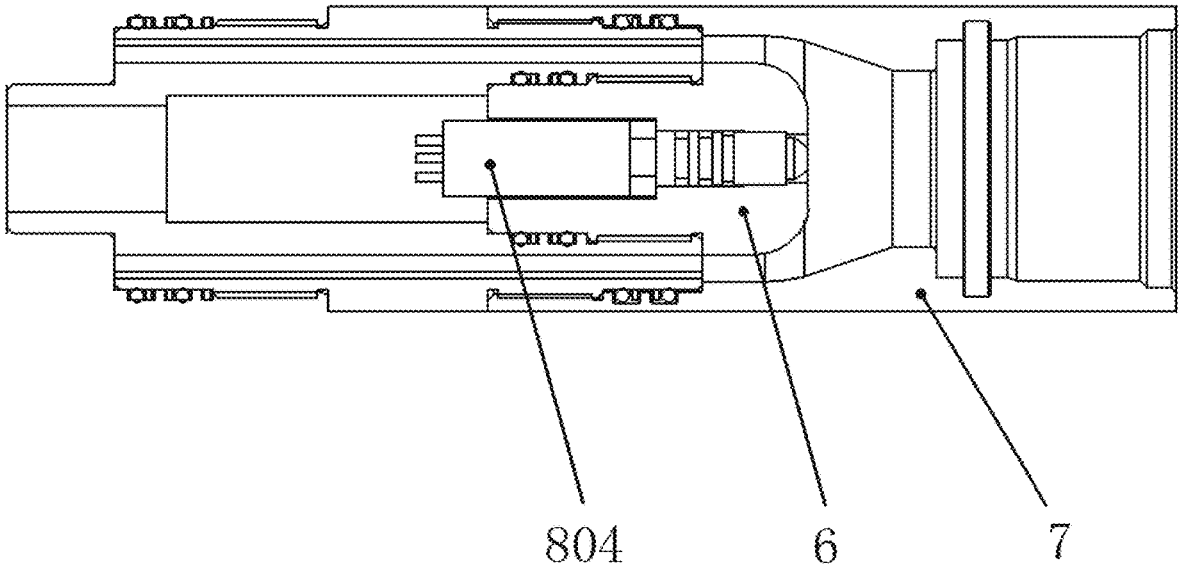
FIG. 3 is a cross-sectional view of the lower adapter sleeve, the end socket and the female sleeve in an embodiment of this disclosure.

As shown in FIG. 1 and FIG. 3, a downhole throttling device based on wireless control comprises an inlet nozzle 1, a throttling assembly 2, an electrical sealing cylinder 3, a gas guide cylinder 4, a lower adapter sleeve 5, an end socket 6, a female sleeve 7, and electrical components 8, wherein the inlet nozzle 1 is connected to the throttling assembly 2, the throttling assembly 2 is connected to the electrical sealing cylinder 3 and the gas guide cylinder 4, the electrical sealing cylinder 3 is arranged in the gas guide cylinder 4, the electrical sealing cylinder 3 and the gas guide cylinder 4 are both connected to the lower adapter sleeve 5, the lower adapter sleeve 5 is respectively connected to the end socket 6 and the female sleeve 7, the end socket 6 is in the female sleeve 7, and the electrical components 8 are arranged in the electrical sealing cylinder 3.

Figure 2:
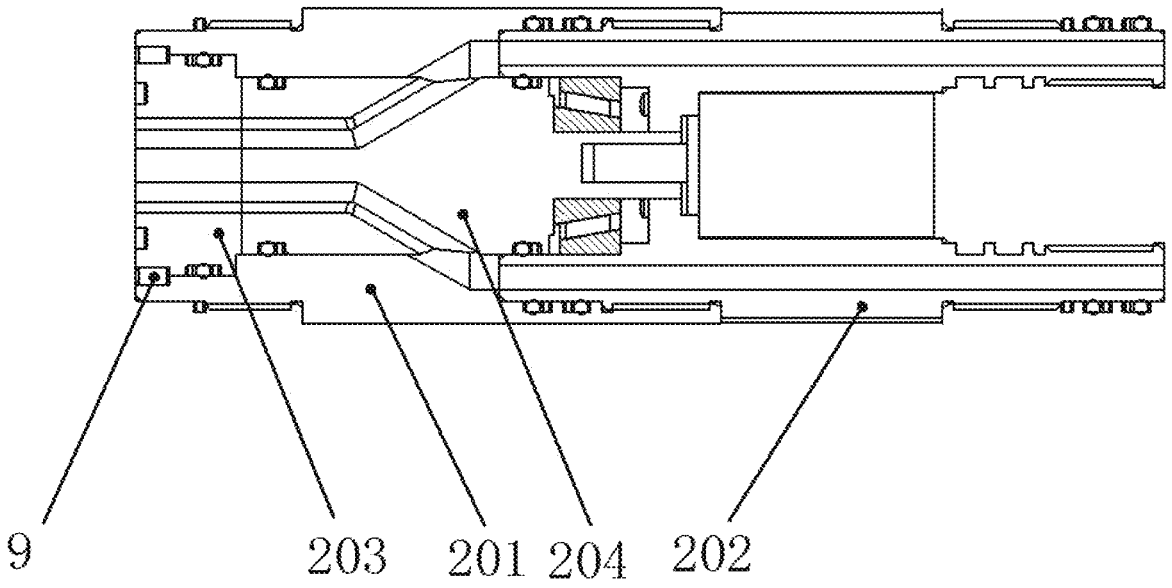
FIG. 2 is a cross-sectional view of a throttling assembly in an embodiment of this disclosure.

As shown in FIG. 2, the throttling assembly 2 comprises an upper adapter sleeve 201, a middle adapter sleeve 202, a static valve 203, and a moving valve 204, wherein the upper adapter sleeve 201 is respectively screwed to the inlet nozzle 1 and the middle adapter sleeve 202, the middle adapter sleeve 202 is respectively screwed to the electrical sealing cylinder 3 and the gas guide cylinder 4, the static valve 203 is arranged in the upper adapter sleeve 201, the moving valve 204 is arranged in the upper adapter sleeve 201 and the middle adapter sleeve 202, and the moving valve 204 is connected to the middle adapter sleeve 202 via a bearing.

Preferably, the bearing connected between the moving valve 204 and the middle adapter sleeve 202 is a roller bearing.

The static valve 203 is provided with a plurality of ventilation ducts communicating with the inlet nozzle 1, the movable valve 204 is provided with a plurality of ventilation ducts at positions corresponding to that of the static valve 201, and the middle adapter sleeve 202 is provided with a plurality of ventilation ducts communicating with the gas guide cylinder 4 at positions corresponding to that of the moving valve 204.

As shown in FIG. 1, the electrical components 8 comprise a motor 801, a circuit control assembly 802, a battery assembly 803, and a sensor 804, wherein the output shaft of the motor 801 is connected to the moving valve 204, the motor 801, the battery assembly 803 and the sensor 804 are electrically connected to the circuit control assembly 803, the motor 801, the circuit control assembly 802 and the battery assembly 803 are arranged in the electrical sealing cylinder 3, the sensor 804 is arranged in the end socket 6, and the sensing probe of the sensor 804 passes through the end socket and is in the female sleeve 7. A signal transceiver and an integrated control chip are arranged in the circuit control assembly.

The sensor 804 is a temperature and pressure integrated sensor.

A locating pin 9 for preventing rotation is provided between the upper adapter sleeve 201 and the static valve 203.

The lower adapter sleeve 5 is provided with a plurality of ventilation ducts.

Preferably, a sealing ring and a stop ring are arranged on the connecting circumferential surface of the inlet nozzle 1, the upper adapter sleeve 201, the middle adapter sleeve 202, the static valve 203, the moving valve 204, the electrical sealing cylinder 3, the gas guide cylinder 4, the lower adapter sleeve 5, the end socket 6 and the female sleeve 7.

The operation process of this disclosure is as follows: the oil and natural gas at the bottom of the well enter from the inlet nozzle 1, flow through the ventilation ducts on the static valve 203 into the ventilation ducts of the moving valve 204, and then form the ventilation ducts of the moving valve 204 through the ventilation ducts of the middle transfer sleeve 202 into the gas guide cylinder 4, and then enter the female sleeve 7 through the lower adapter sleeve 5 and merge there for the next production process. The temperature and pressure of the oil and natural gas in the female sleeve 7 is detected by the sensor 804. The detected data is transmitted to the control host on the well via the circuit control assembly 802. The control host is configured to send instructions to the circuit control assembly 802. The integrated control chip of the circuit control assembly 802 is configured to output an opening degree instruction to the motor using the integrated opening degree calculation control module. The motor runs the corresponding angle in accordance with the opening degree instructions, and drives the throttling nozzle to an opening position corresponding to the expected production. At the same time, the temperature and pressure sensor arranged in the throttling device detects the temperature and pressure parameters in front of and behind the throttling device in real time, and a downhole control chip performs information fusion processing on the real-time production based on the detected parameters, feedbacks and checks whether production allocation is successfully implemented in accordance with the instructions.

The specific embodiments described above describe the objectives, technical solutions and beneficial effects of this disclosure in further detail. It should be understood that the above descriptions are only specific embodiments of this disclosure and are not intended to limit the scope of this disclosure. Any modification, equivalent replacement, improvement, etc. made in accordance with the spirit and principle of this disclosure shall be regarded as within the protection scope of this disclosure.

What is claimed is:

1. A downhole throttling device based on wireless control, comprising an inlet nozzle (1), a throttling assembly (2), an electrical sealing cylinder (3), a gas guide cylinder (4), a lower adapter sleeve (5), an end socket (6), a female sleeve (7), and electrical components (8), wherein the inlet nozzle (1) is connected to the throttling assembly (2), the throttling assembly (2) is connected to the electrical sealing cylinder (3) and the gas guide cylinder (4), the electrical sealing cylinder (3) is arranged in the gas guide cylinder (4), the electrical sealing cylinder (3) and the gas guide cylinder (4) are both connected to the lower adapter sleeve (5), the lower adapter sleeve (5) is respectively connected to the end socket (6) and the female sleeve (7), the end socket (6) is in the female sleeve (7), and the electrical components (8) are arranged in the electrical sealing cylinder (3), wherein the lower adapter sleeve (5) is provided with a plurality of ventilation ducts.

2. The downhole throttling device based on wireless control according to claim 1, wherein the throttling assembly (2) comprises an upper adapter sleeve (201), a middle adapter sleeve (202), a static valve (203), and a moving valve (204), wherein the upper adapter sleeve (201) is respectively connected to the inlet nozzle (1) and the middle adapter sleeve (202), the middle adapter sleeve (202) is respectively connected to the electrical sealing cylinder (3) and the gas guide cylinder (4), the static valve (203) is arranged in the upper adapter sleeve (201), the moving valve (204) is arranged in the upper adapter sleeve (201) and the middle adapter sleeve (202), and the moving valve (204) is connected to the middle adapter sleeve (202) via a bearing.

3. The downhole throttling device based on wireless control according to claim 2, wherein the static valve (203) is provided with a plurality of ventilation ducts communicating with the inlet nozzle (1), the movable valve (204) is provided with a plurality of ventilation ducts at positions corresponding to that of the static valve (201), and the middle adapter sleeve (202) is provided with a plurality of ventilation ducts communicating with the gas guide cylinder (4) at positions corresponding to that of the moving valve (204).

4. The downhole throttling device based on wireless control according to claim 1, wherein the electrical components (8) comprise a motor (801), a circuit control assembly (802), a battery assembly (803), and a sensor (804), wherein an output shaft of the motor (801) is connected to the moving valve (204), the motor (801), the battery assembly (803) and the sensor (804) are electrically connected to the circuit control assembly (803), the motor (801), the circuit control assembly (802) and the battery assembly (803) are arranged in the electrical sealing cylinder (3), the sensor (804) is arranged in the end socket (6), and a sensing probe of the sensor (804) passes through the end socket (6) and is in the female sleeve (7).

5. The downhole throttling device based on wireless control according to claim 4, wherein the sensor (804) is a temperature and pressure integrated sensor.

6. The downhole throttling device based on wireless control according to claim 2, wherein a locating pin (9) for preventing rotation is provided between the upper adapter sleeve (201) and the static valve (203).

* * * * *